US008545256B2

(12) United States Patent
Huffman et al.

(10) Patent No.: US 8,545,256 B2
(45) Date of Patent: Oct. 1, 2013

(54) ELECTRICAL CONNECTOR FOR USE WITH NATO EQUIPMENT

(75) Inventors: Scott Huffman, Delaware, OH (US); Mark Huffman, Delaware, OH (US)

(73) Assignee: Graywacke Engineering, Inc., Lexington, OH (US)

( * ) Notice: Subject to any disclaimer, the term of this patent is extended or adjusted under 35 U.S.C. 154(b) by 265 days.

(21) Appl. No.: 12/979,408

(22) Filed: Dec. 28, 2010

(65) Prior Publication Data

US 2012/0164891 A1 Jun. 28, 2012

(51) Int. Cl.
*H01R 13/58* (2006.01)

(52) U.S. Cl.
USPC ..... 439/454; 439/277; 439/483; 439/583

(58) Field of Classification Search
USPC ..... 439/277, 449, 451, 452, 454, 583
See application file for complete search history.

(56) References Cited

U.S. PATENT DOCUMENTS

| | | | | | |
|---|---|---|---|---|---|
| 1,929,920 | A | * | 10/1933 | Fullman | 439/452 |
| 2,829,358 | A | * | 4/1958 | Testori | 439/321 |
| 3,040,288 | A | * | 6/1962 | Edlen et al. | 439/452 |
| 3,452,321 | A | | 6/1969 | Carissimi et al. | |
| 3,721,939 | A | | 3/1973 | Paugh | |
| 3,744,008 | A | * | 7/1973 | Castellani | 248/56 |
| 3,893,743 | A | | 7/1975 | Wallo | |
| 3,956,575 | A | * | 5/1976 | Sutherland | 174/87 |
| D242,464 | S | | 11/1976 | Acosta | |
| 4,386,818 | A | | 6/1983 | Millhimes et al. | |
| 5,281,147 | A | * | 1/1994 | Hughes | 439/35 |
| 5,340,330 | A | | 8/1994 | Dolson et al. | |
| 5,586,906 | A | * | 12/1996 | Staros et al. | 439/483 |
| 5,932,841 | A | | 8/1999 | Matsumoto et al. | |
| 6,115,277 | A | | 9/2000 | Plichta et al. | |
| 6,172,892 | B1 | | 1/2001 | Plichta et al. | |
| 6,220,888 | B1 | | 4/2001 | Correa | |
| 6,363,272 | B1 | | 3/2002 | Combs | |
| 6,559,556 | B1 | | 5/2003 | Wills | |
| 6,602,088 | B1 | | 8/2003 | Zhu | |
| 7,186,137 | B2 | | 3/2007 | Rock | |
| 7,306,484 | B1 | * | 12/2007 | Mahoney et al. | 439/578 |
| 7,364,469 | B2 | | 4/2008 | Huffman et al. | |
| 8,288,667 | B2 | * | 10/2012 | Chiou | 174/652 |
| 2007/0099488 | A1 | * | 5/2007 | Huffman et al. | 439/503 |
| 2007/0232136 | A1 | * | 10/2007 | Fryzek et al. | 439/578 |
| 2012/0164891 | A1 | * | 6/2012 | Huffman et al. | 439/675 |
| 2012/0270435 | A1 | * | 10/2012 | Hale et al. | 439/476.1 |

* cited by examiner

*Primary Examiner* — James Harvey
(74) *Attorney, Agent, or Firm* — Timothy D. Bennett; Emerson Thomson Bennett

(57) ABSTRACT

To attach a cable to a NATO slave receptacle, a wire from the cable may be passed through an opening in a cable receiving member and connected to a tab formed on a NATO plug. The cable receiving member may then be attached to the NATO plug. The NATO plug may then be engaged to a NATO slave receptacle to create an electrical connection between the NATO slave receptacle and the cable. If desired, the NATO plug and receiving member can be easily detached from the cable and used with another cable.

21 Claims, 9 Drawing Sheets

ELECTRICAL CONNECTOR FOR USE WITH NATO EQUIPMENT

I. BACKGROUND

A. Field of Invention

This invention pertains to the art of methods and apparatuses regarding electrical connectors and cables, and more specifically to methods and apparatus regarding a NATO slave connector designed to connect to a NATO slave receptacle typically found on military vehicles.

B. Description of the Related Art

It is known in the art of military vehicles, such as the North Atlantic Treaty Organization (NATO) Humvee, to provide a direct current (DC) battery supply. This battery supply is typically 24 volts and is typically used to provide power to various devices, such as computer systems and to charge other batteries, etc. As a result, such vehicle batteries typically have a power receptacle typically referred to as a NATO slave receptacle. It is also known to provide a NATO standardized slave connector that fits the NATO slave receptacle so that power can be extracted therefrom.

Many known NATO slave connectors work well for their intended purpose. One such NATO slave connector is provided in U.S. Pat. No. 7,364,469 which has common inventorship and which is incorporated herein by reference. One problem with known NATO slave connectors, however, is that they are limited in terms of the size of cables that they can be used with. Another problem with known NATO slave connectors is that they are relatively difficult to attach to the cables that they can be used with. The NATO slave connector subject to U.S. Pat. No. 7,364,469, for example, requires an overmolding process to attach the cable to the NATO slave connector.

The present invention provides methods and apparatuses for a NATO slave connector that overcomes the foregoing difficulties and others while providing better and more advantageous overall results.

II. SUMMARY OF THE INVENTION

According to one embodiment of this invention an electric connector may comprise: a plug comprising: a first connection site that is suitable to engage a receptacle; and, a second connection site that electrically communicates with the first connection site, the second connection site comprising a first tab; and, a cable receiving member comprising: an attachment surface that attaches to the attachment surface of the plug; and, an opening that receives the first associated wire and the associated electric cable and through which the first associated wire passes to be electrically connected to the first tab.

According to another embodiment of this invention, a NATO slave connector comprises: a NATO plug comprising: an attachment surface; a first connection site that is suitable to engage a NATO slave receptacle; and, a second connection site that electrically communicates with the first connection site, the second connection site comprising a first tab; a first electric terminal comprising: a first connection site that is that is suitable to be electrically connected to a first associated wire from an associated electric cable; and, a second connection site that electrically communicates with the first connection site and that is suitable to be electrically connected to the first tab; and, a cable receiving member comprising: an attachment surface that attaches to the attachment surface of the NATO plug; an opening that receives the first associated wire and the associated electric cable and through which the first associated wire passes to be electrically connected to the first tab via the first electric terminal.

According to still another embodiment of this invention, a method may comprise the steps of: (A) providing a NATO slave receptacle; (B) providing an electric cable comprising first and second wires; (C) providing a NATO slave connector comprising: (1) a NATO plug comprising: an attachment surface; a first connection site; and, a second connection site that electrically communicates with the first connection site, the second connection site comprising first and second tabs; and, (2) a cable receiving member comprising: an attachment surface; and, an opening; (D) passing the first and second wires through the opening in the cable receiving member; (E) connecting the first and second wires to the first and second tabs, respectively; (F) attaching the attachment surface of the cable receiving member to the attachment surface of the NATO plug; and, (G) engaging the first connection site of the NATO slave connector with the NATO slave receptacle to create an electrical connection between the NATO slave receptacle and the cable.

One advantage of this invention is that a cable can be easily attached to the NATO slave connector.

Another advantage of this invention is that different sized cables can be attached to the same NATO slave connector.

Yet another advantage of this invention, according to one embodiment, is that the NATO slave connector can be adjusted to grip the cable.

Still other benefits and advantages of this invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF EMBODIMENTS OF THE INVENTION

Figure 1:
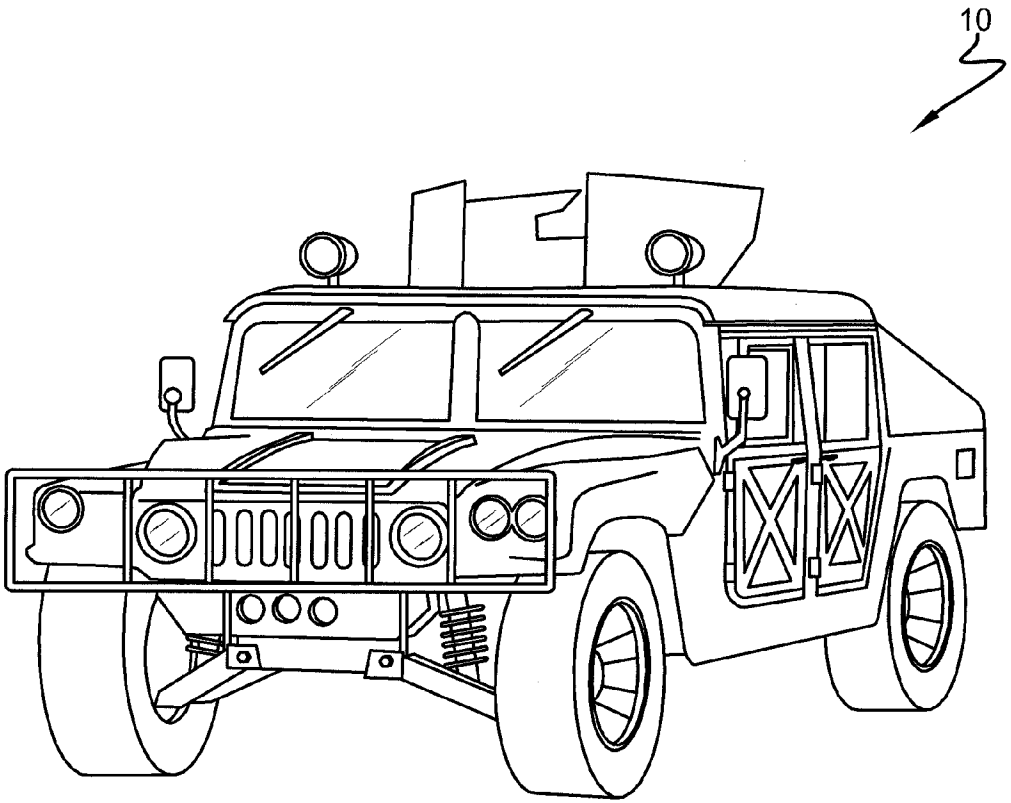
PRIOR ART FIG. 1
FIG. 1 is a perspective side view of a military vehicle having a battery and a NATO slave receptacle that may connect to the NATO slave connector of this invention.

Referring now to the drawings wherein the showings are for purposes of illustrating embodiments of the invention only and not for purposes of limiting the same, and wherein like reference numerals are understood to refer to like components, FIG. 1 shows a military vehicle 10 equipped with a battery (not shown but well known to those of skill in the art) and a NATO slave receptacle (not shown but well known to those of skill in the art) that may connect to a NATO slave connector according to this invention. It is to be understood that the military vehicle 10 is exemplary only as the NATO connector of this invention may be used with other vehicles and in non-vehicle applications as well.

Figure 2:
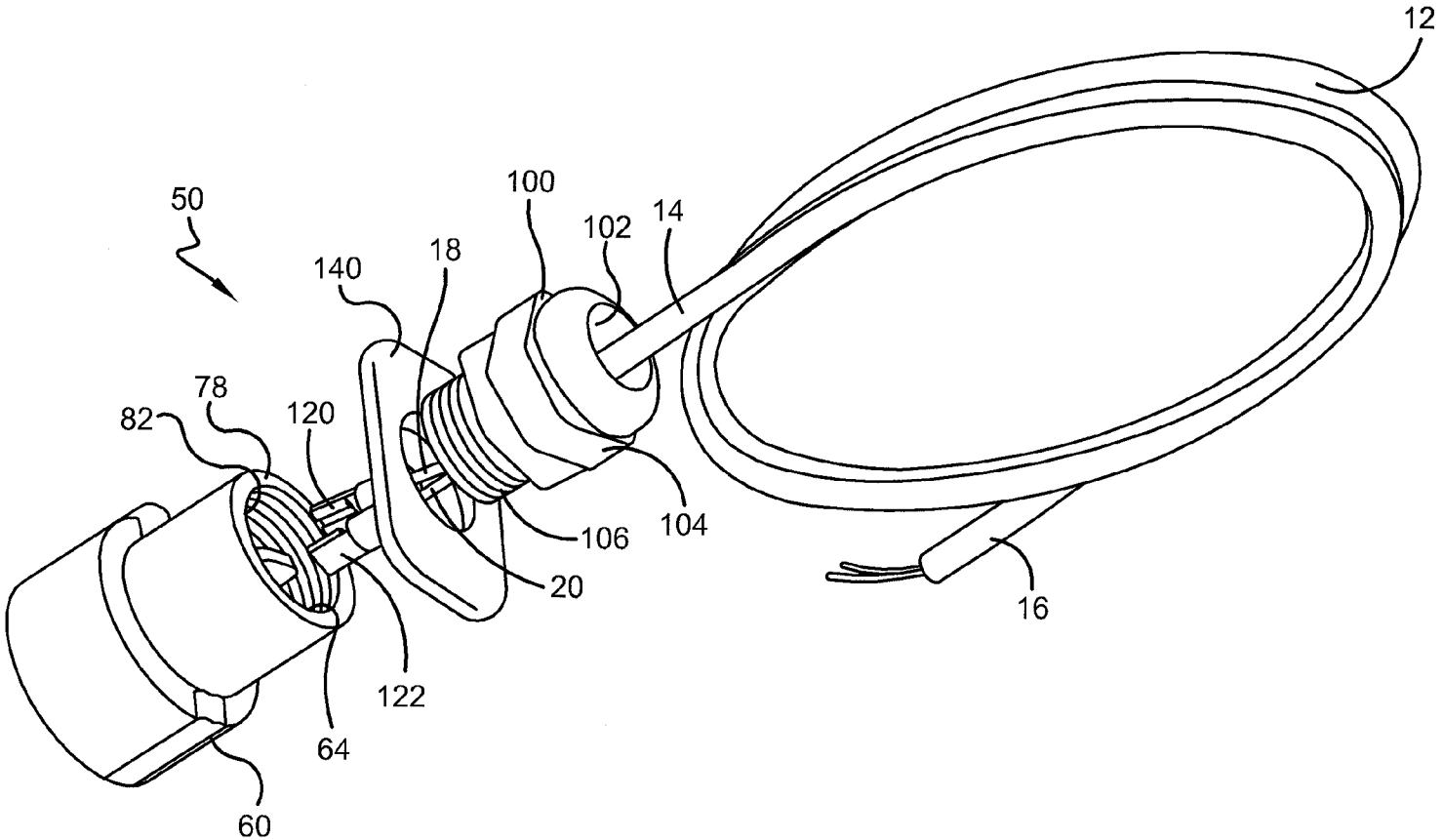
FIG. 2 is a perspective side view of a NATO slave connector being attached to a cable.
Figure 3:
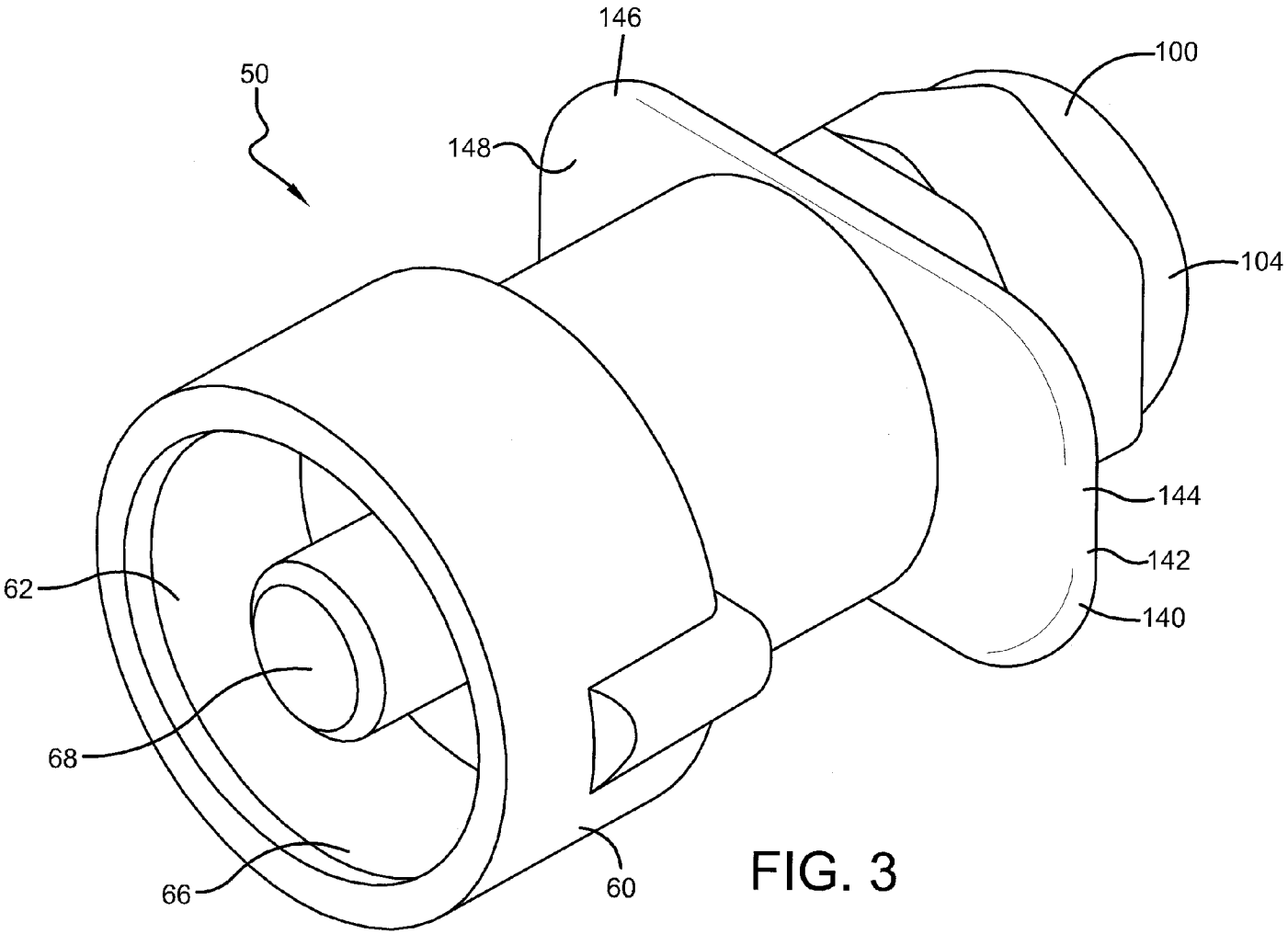
FIG. 3 is a perspective front end view of a NATO slave connector.
Figure 4:
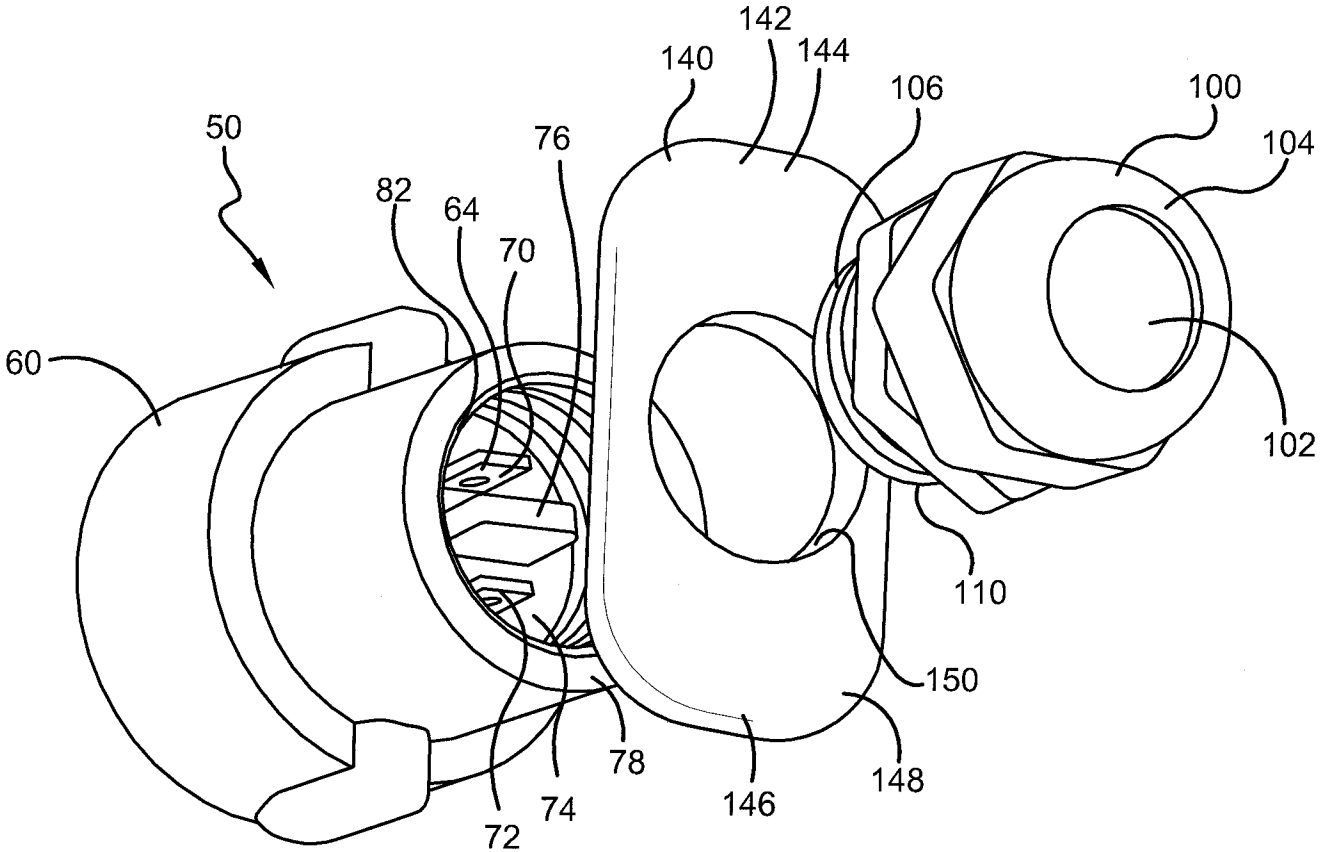
FIG. 4 is a perspective back end view of a NATO slave connector shown disassembled.
Figure 5:
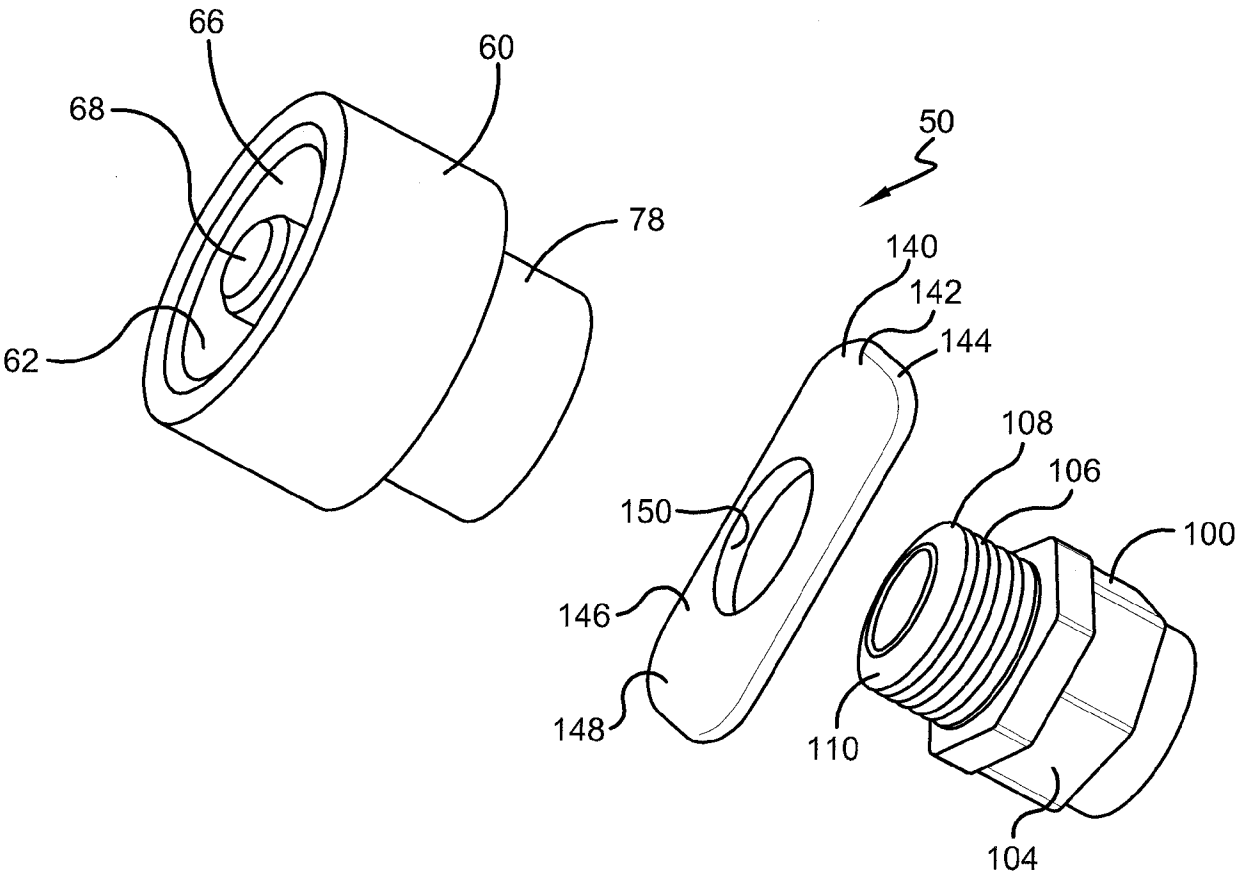
FIG. 5 is a perspective side view of a NATO slave connector shown disassembled.

With reference now to FIGS. 1 and 2, the NATO slave connector 50 of this invention may be used to connect a cable 12 to a NATO slave receptacle. The cable 12 may be of any type, size and loading chosen with the sound judgment of a person of skill in the art. In one embodiment, the cable 12 and connector 50 are suited to transfer power from a 24 volt direct current (DC) battery power source positioned on the military vehicle 10 and are designed to permit a maximum current draw of about 35 amperes (amps). With this relatively reduced current draw limit, the NATO connector 50 can be formed of a compact size and formed with minimal cost. The cable 12 may have a first end 14 that connects to the NATO slave receptacle and a second end 16 that can be connected to any device chosen with the sound judgment of a person of skill in the art. Non-limiting examples of devices that the second end 16 may be electrically connected to include computers, inverters, motors, weapon systems, flash lights, and converters. In one embodiment, the cable 12 may use 2-conductor cable and thus may include a pair of wires 18, 20, as shown.

With reference now to FIGS. 3-6, the NATO connector 50 may comprise a NATO plug 60 that may include a first connection site 62 that is suitable to engage a NATO slave receptacle and a second connection site 64 that electrically communicates with the first connection site 62 in a known manner. The first connection site 62 may include a ring member 66 and a contact pole 68 axially centered within the ring member 66, as shown, to connect to the NATO slave receptacle in a known manner. The second connection site 64 may be positioned on the opposite end of the NATO plug 60 from the first connection site 62. The second connection site 64 may include a pair of tabs 70, 72 that extend from a plug surface 74 that may be planar, as shown. An insulation wall 76 may be positioned between the tabs 70, 72 to diminish the chances of inadvertently creating a short circuit. The insulation wall 76 may be sized and shaped in any manner chosen with the sound judgment of a person of skill in the art. For the embodiment shown, the insulation wall 76 extends from the plug surface 74 at a location equidistant between the tabs 70, 72. The insulation wall 76 may also extend farther out from the plug surface 74 than the tabs 70, 72 and may have a width greater than the width of the tabs 70, 72, as shown. The insulation wall 76 may be formed of an electric insulation material.

With continuing reference to FIGS. 3-6, the NATO plug 60 may comprise a wall structure 78 to protect the second connection site 64. The wall structure 78 can be sized and shaped in any manner chosen with the sound judgment of a person of skill in the art. For the embodiment shown, the wall structure 78 is circular in cross-section and extends out farther from the plug surface 74 than the tabs 70, 72 and the insulation wall 76. The wall structure 78 may define a cavity or female portion 82. The NATO plug 60 may also have, as referenced in FIG. 6, an attachment surface 80 for purposes to be discussed further below. While the attachment surface 80 may be of any type and style chosen with the sound judgment of a person of skill in the art, for the embodiment shown it includes threads 84 and is positioned on an inner surface of the wall structure 78.

The NATO connector 50 may also comprise a cable receiving member 100 that may include an opening 102 that receives the cable 12 and its wires 18, 20, as shown. The opening 102 can be sized and oriented in any manner chosen with the sound judgment of a person of skill in the art. For the embodiment shown, the opening 102 is radially centered and has a diameter that is larger than the outside diameter (or largest outside dimension) of the cable 12. This permits a broad range of cable diameters to be used. In one specific embodiment, the opening 102 is 0.5 inches in diameter. In one embodiment, the cable receiving member 100 includes a cable grip 104 that is adjustable to reduce the size of the opening 102 and to thereby grip the electric cable 12. In this way the cable receiving member 100 can be tightly secured or sealed to the outer surface of the cable 12. In one specific embodiment, the cable grip 104 is a liquid tight strain relief fitting.

Still referring to FIGS. 3-6, the cable receiving member 100 may also have an attachment surface 106 that attaches to the attachment surface 80 of the NATO plug 60. In one embodiment, the attachment surface 106 includes threads 108 that engage the threads 84 on the attachment surface 80 of the NATO plug 60 in any known manner. The cable receiving member 100 may have a protrusion or male portion 110 and the threads 108 may be positioned on an outer surface of the male portion 110. In one specific embodiment, the cable receiving member 100 can be attached to the NATO plug 60 by inserting the male portion 110 into the female portion 82 and then rotating the cable receiving member 100 with respect to the NATO plug 60. As this rotation occurs, the threads 108 on the cable receiving member 100 engage the threads 84 on the NATO plug 60 and the cable receiving member 100 is tightened to the NATO plug 60 in a known manner.

Figure 6:
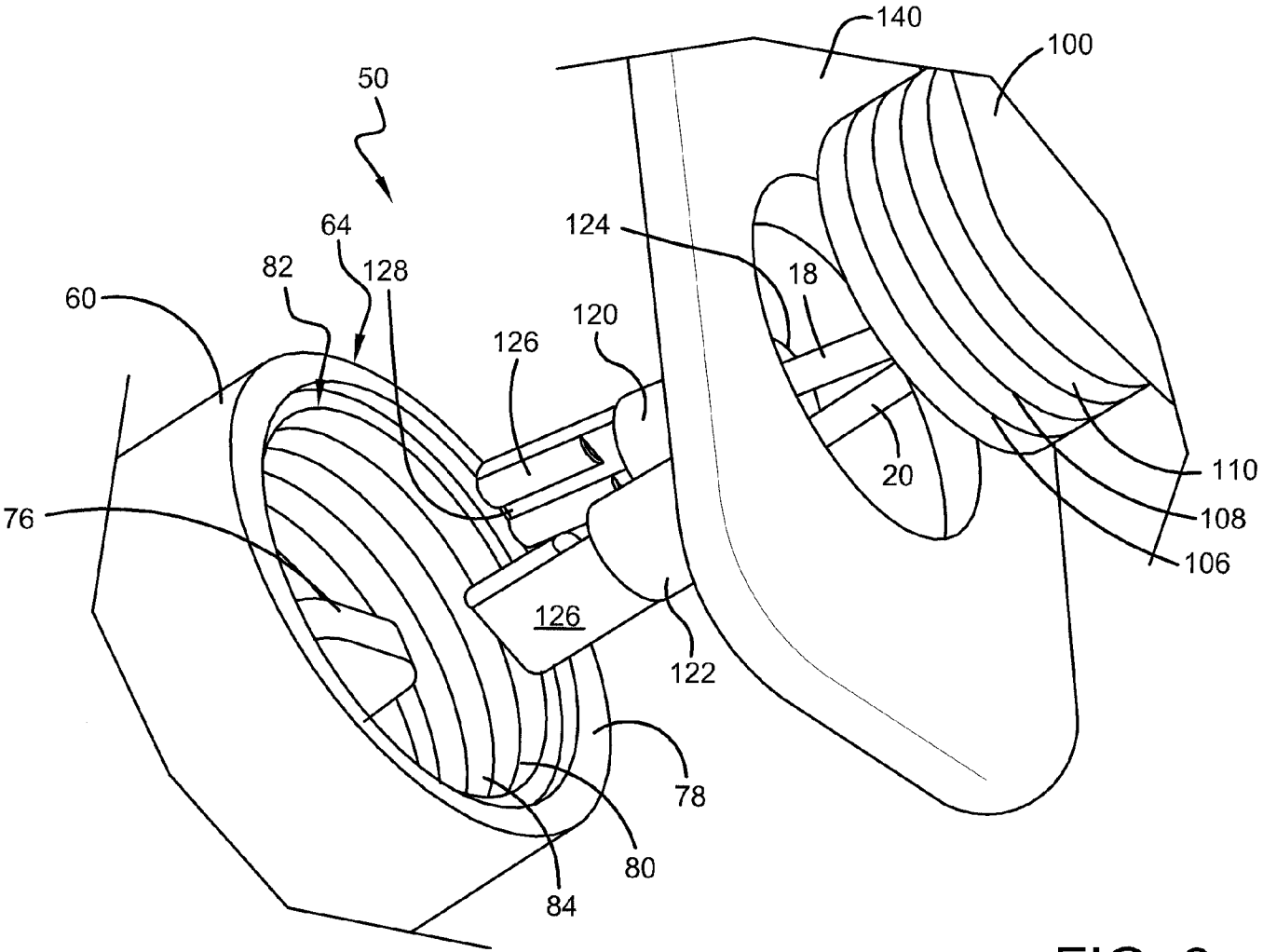
FIG. 6 is a close up view of a portion of the NATO slave connector shown in FIG. 2.

With reference now to FIGS. 2 and 6, while the wires 18, 20 of the cable 12 may be attached to the NATO connector 50 in any manner chosen with the sound judgment of a person of skill in the art, such as by soldering, for the embodiment shown an electric terminal for each wire or conductor may be used. Since the embodiment shown uses two wires, 18, 20, there may be two corresponding electric terminals 120, 122. Of course any number of wires or conductors chosen with the sound judgment of a person of skill in the art may be used with this invention. Each electric terminal 120, 122 may include a first connection site 124 that is that is suitable to be electrically connected to the corresponding wire (18 or 20) and a second connection site 126 that electrically communicates with the first connection site 124 and that is suitable to be electrically connected to the corresponding tab (70 or 72). While the electric terminals 120, 122 can attach to the corresponding wires and tabs in any manner chosen with the sound judgment of a person of skill in the art, for the embodiment shown the first connection site 124 can be crimped to the corresponding wire in a known manner and the second connection site 126 comprises a slot 128 that can be pushed around the corresponding tab in a known manner.

With reference now to FIGS. 3-6, the NATO connector 50 may comprise a pull handle 140. The pull handle 140 may have a first end 142 that comprises a first pull surface 144 and a second end 146 that comprises a second pull surface 148. The pull handle 140 may also have an aperture 150 that receives either the NATO plug 60 or the cable receiving member 100. For the embodiment shown, the aperture 150 receives the male portion 110 of the cable receiving member 100. To assemble the pull handle 140, it may be sandwiched between the NATO plug 50 and the cable receiving member 100. Once the pull handle 140 has been assembled to the NATO connector 50, the pull surfaces 144, 146 can be used (pulled on) by an operator to disconnect the NATO connector 50 and the electric cable 12 from the associated NATO slave receptacle. To improve the accessibility of the pull handle 140, the pull surfaces 144, 146 may extend outwardly beyond the juxtaposed outer surfaces of the NATO plug 60 and the cable receiving member 100, as shown.

Figure 7:
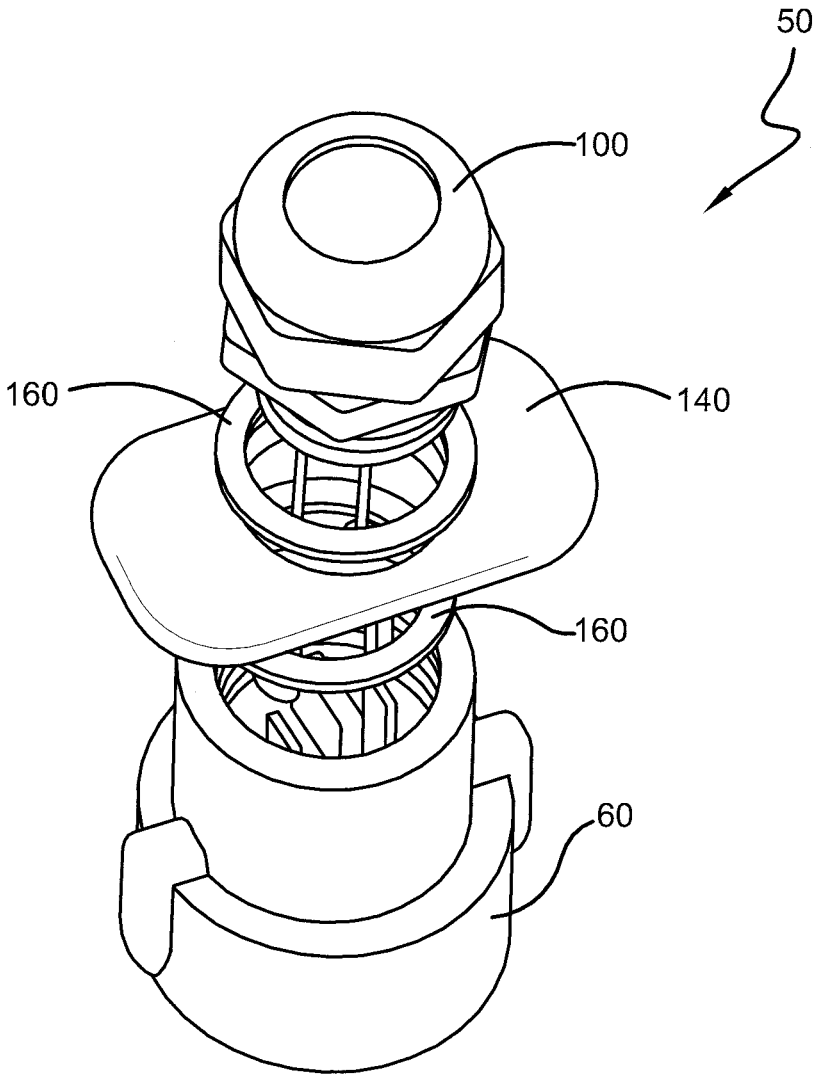
FIG. 7 is a perspective top view of a NATO slave connector shown disassembled.

With reference now to FIG. 7, in another embodiment, the NATO connector 50 may use one or more washers 160 formed of any material, of any size and of any location chosen with the sound judgment of a person of skill in the art. For the embodiment shown, two washers 160, 160 are used on opposite sides of the pull handle 140. Each washer 160 may be used to increase the seal between the NATO connector 50 components.

With reference now to FIGS. 1-7, in operation the distal ends of the wires 18, 20 are passed through the opening 102 in the cable receiving member 100. If the electric terminals 120, 122 are used, their first connection sites 124, 124 are then attached (by crimping in one embodiment) to the corresponding wires 18, 20. Alternatively, the electric terminals 120, 122 may be attached to the wires 18, 20 prior to passing the terminals 120, 122 and the distal ends of the wires 18, 20 through the opening 102 in the cable receiving member 100. If a pull handle 140 is used, its aperture 150 may then be inserted around the distal ends of the wires 18, and, in one embodiment, around the male portion 110 of the cable receiving member 100. If one or more washers 160, 160 are used, they similarly may be inserted around the distal ends of the wires 18, 20. The wires 18, 20 are then connected to the tabs 70, 72. If the electric terminals 120, 122 are used, their second connection sites 126, 126 are then attached to the corresponding tabs 70, 72 (by pushing the slots 128, 128 around the tabs 70, 72, in one embodiment).

The male portion 110 of the cable receiving member 100, if used, may then be inserted within the female portion 82 of the NATO plug 60. If the attachment surfaces 80, 106 have threads 84, 108, they are engaged. In one embodiment, the cable receiving member 100 is rotated with respect to the NATO plug 60 as the threads 84, 108 engage. As the cable receiving member 100 is attached to the NATO plug 60, the pull handle 140, if used, may be sandwiched between the NATO plug 60 and the cable receiving member 100. If the cable receiving member 100 has a cable grip 104, it may then be adjusted to reduce the size of the opening 102 in the cable receiving member 100 to thereby grip, hold and/or seal the electric cable 12. With the NATO slave connector 50 thus connected to the cable 12, the first connection site 62 of the NATO plug 60 may then be engaged with the NATO slave receptacle to create an electrical connection between the NATO slave receptacle and the cable 12. If desired, the first connection site 62 of the NATO plug 60 may be disengaged from the NATO slave receptacle by pulling on the pull surfaces 144, 148 of the pull handle 140. The NATO connector 50 and cable 12 can then be engaged to and disengaged from the NATO slave receptacle as desired. If it becomes desirable to remove the NATO connector 50 from the cable 12, the steps noted above can be reversed and the NATO connector 50 can then be used with another cable.

Figure 9:
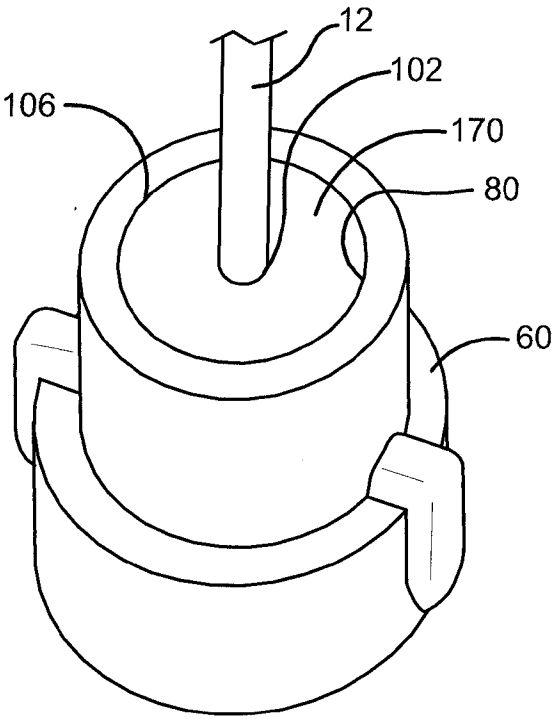
FIG. 9 is a view similar to that shown in FIG. 8 but with a potting material used as a cable receiving member.
Figure 8:
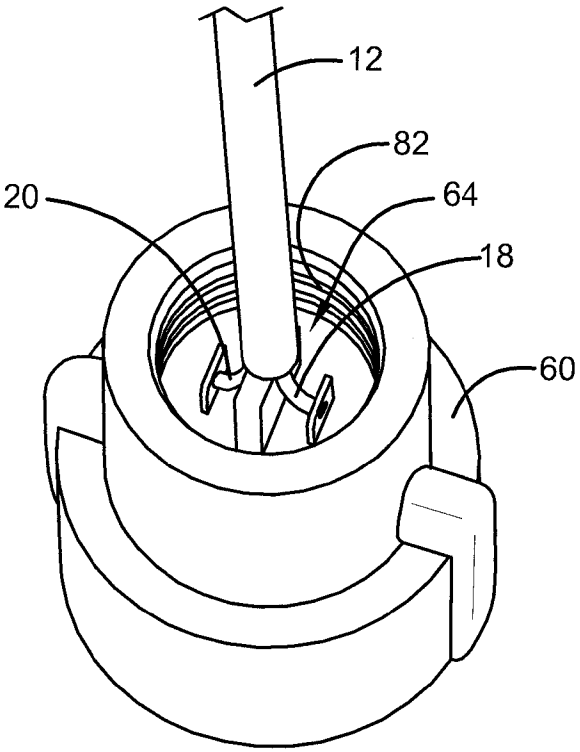
FIG. 8 is a perspective top view of a NATO plug showing a cable attached.

With reference now to FIGS. 8-9, in another embodiment, the cable receiving member 100 is simply a potting material 170 that is inserted around the second connection site 64 after the wire(s) 18, 20 have been attached. As is well known to those of skill in the art, potting materials are used on electric connections to enhance mechanical strength, provide electrical insulation, and enhance vibration and shock resistance. For the embodiment shown, the potting material 170 has an opening 102 that receives the cable 12 and an attachment surface 106 that attaches to the attachment surface 80 of the NATO plug 60 within the cavity or female portion 82.

Figure 10:
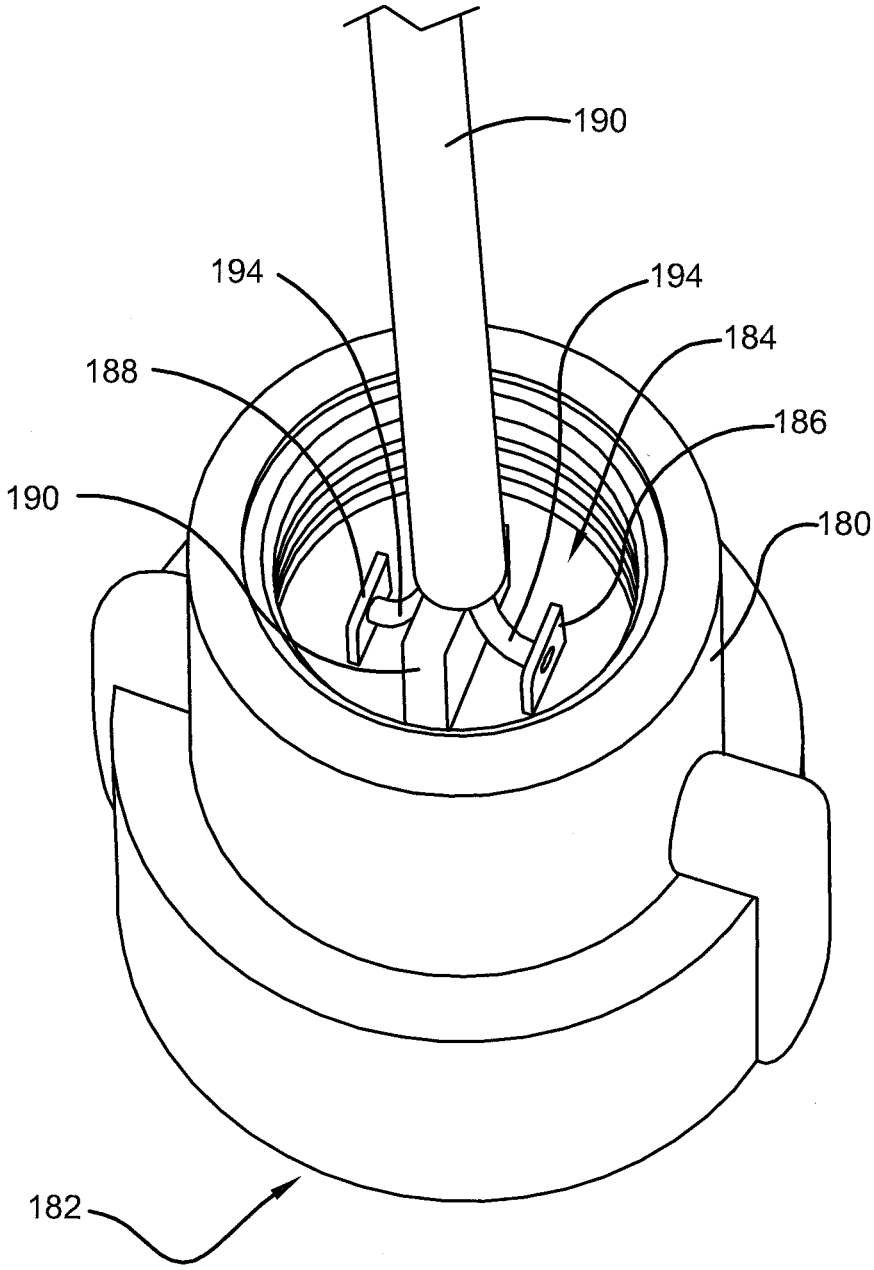
FIG. 10 is a perspective top view of a non-NATO plug showing a cable attached.

With reference now to FIG. 10, it should also be noted that this invention is not limited to NATO electric connectors. With reference to FIG. 10, a plug 180 may have a have a first connection site 182 that is suitable to engage any receptacle chosen with the sound judgment of a person of skill in the art and a second connection site 184 that electrically communicates with the first connection site 182 in a known manner. The second connection site 184 may be positioned on the opposite end of the plug 180 from the first connection site 182 and may include a pair of tabs 186, 188 that operate similar to the tabs 70, 72 explained above. An insulation wall 190 may be positioned between the tabs 186, 188 to diminish the chances of inadvertently creating a short circuit. A cable 190 and one or more of its wires or conductors 194, 194 may be connected to the tabs 186, 188 similar to the methods noted above. A cable receiving member, not shown but similar to the embodiments noted above, may be used with the plug 180 as explained above.

Numerous embodiments have been described, hereinabove. It will be apparent to those skilled in the art that the above methods and apparatuses may incorporate changes and modifications without departing from the general scope of this invention. For example, a protective covering may be provided on the outer surface of the NATO connector 50. It is also contemplated to design the NATO plug 60 with a male portion and the cable receiving member 100 with a female portion that receives the male portion. It is intended to include all such modifications and alterations in so far as they come within the scope of the appended claims or the equivalents thereof.

We claim:

1. An electric connector comprising:

a plug comprising: an attachment surface; a first connection site that is suitable to engage an associated receptacle; a second connection site that electrically communicates with the first connection site, the second connection site comprising first and second tabs that extend from a plug surface; and, an insulation wall that: extends from the plug surface substantially parallel to the first and second tabs; is positioned between the first and second tabs; and, comprises an electric insulation material; and, a cable receiving member comprising: an attachment surface that attaches to the attachment surface of the plug; and, an opening that receives first and second wires of an associated electric cable and through which the first and second wires pass to be electrically connected to the first and second tabs.

2. The electric connector of claim 1 further comprising:

a pull handle comprising: an aperture that receives one of the plug and the cable receiving member; and, a first pull surface that is suitable to be used by an associated operator to disconnect the electric connector and the associated electric cable from the associated receptacle.

3. The electric connector of claim 2 wherein the pull handle:

is sandwichable between the plug and the cable receiving member when the cable receiving member is attached to the plug;

has a first end that comprises the first pull surface and that extends outwardly beyond its juxtaposed outer surfaces of the plug and the cable receiving member; and, further comprises a second end that comprises a second pull surface and that extends outwardly beyond its juxtaposed outer surfaces of the plug and the cable receiving member.

4. The electric connector of claim 1 wherein:

the insulation wall extends farther out from the plug surface than the first and second tabs do.

5. The electric connector of claim 1 wherein:

the insulation wall is positioned substantially equidistant between the first and second tabs.

6. The electric connector of claim 1 wherein the cable receiving member further comprises:

a cable grip that is adjustable to reduce the size of the opening and grip the associated electric cable to secure the associated electric cable to the cable receiving member.

7. The electric connector of claim 1 wherein:

the plug comprises a cavity; and, the cable receiving member is a potting material that is inserted within the cavity.

8. A method comprising the steps of:

(A) providing a NATO slave receptacle;

(B) providing an electric cable comprising first and second wires;

(C) providing a NATO slave connector comprising: (1) a NATO plug comprising: an attachment surface; a first connection site; and, a second connection site that electrically communicates with the first connection site, the second connection site comprising first and second tabs that extend from a plug surface; and an insulation wall that: extends from the plug surface substantially parallel to the first and second tabs; is positioned between the first and second tabs; and, comprises an electric insulation material; and, (2) a cable receiving member comprising: an attachment surface; and, an opening;

(D) passing the first and second wires through the opening in the cable receiving member;

(E) connecting the first and second wires to the first and second tabs, respectively;

(F) attaching the attachment surface of the cable receiving member to the attachment surface of the NATO plug; and, (G) engaging the first connection site of the NATO slave connector with the NATO slave receptacle to create an electrical connection between the NATO slave receptacle and the cable.

9. The method of claim 8 wherein:

step (C) comprises the step of: providing the NATO slave connector with a pull handle comprising an aperture;

after step (E) and before step (F) the method comprises the step of: positioning one of the NATO plug and the cable receiving member within the aperture; and, after step (G) the method further comprises the step of: disengaging the first connection site of the NATO slave connector from the NATO slave receptacle by pulling on the pull handle.

10. The method of claim 9 wherein:

step (C) comprises the step of: providing the pull handle with a first end having a first pull surface and a second end with a second pull surface; and, step (F) comprises the step of: sandwiching the pull handle between the NATO plug and the cable receiving member with the first and second pull surfaces extending outwardly beyond their juxtaposed outer surfaces of the NATO plug and the cable receiving member.

11. The method of claim 8 wherein:

step (C) comprises the step of: providing the attachment surface of the NATO plug with threads and providing the attachment surface of the cable receiving member with threads; and, step (F) comprises the step of: rotating the cable receiving member with respect to the NATO slave connector so that the threads on the attachment surface of the cable receiving member engage the threads on the attachment surface of the NATO slave connector.

12. The method of claim 8 wherein:

step (C) comprises the step of: providing the attachment surface of the NATO plug on a female portion of the NATO plug; and, providing the attachment surface of the cable receiving member on a male portion of the cable receiving member; and, step (F) comprises the step of: inserting the male portion within the female portion.

13. The method of claim 8 wherein:

step (C) comprises the step of: providing the cable receiving member with a cable grip; and, before step (G) the method comprises the step of: adjusting the cable grip to reduce the size of the opening in the cable receiving member to grip the electric cable to secure the associated electric cable to the cable receiving member.

14. The method of claim 8 wherein:

step (C) comprises the steps of: providing the NATO plug with a cavity; and, providing the cable receiving member to be a potting material; and, step (F) comprises the steps of: inserting the potting material of the cable receiving member within the cavity.

15. A NATO slave connector comprising:

a NATO plug comprising: an attachment surface; a first connection site that is suitable to engage a NATO slave receptacle; a second connection site that electrically communicates with the first connection site, the second connection site comprising first and second tabs that extend from a plug surface; and, an insulation wall that: extends from the plug surface substantially parallel to the first and second tabs; is positioned between the first and second tabs; and, comprises an electric insulation material; and, a cable receiving member comprising: an attachment surface that attaches to the attachment surface of the NATO plug; and, an opening that receives first and second wires of an associated electric cable and through which the first and second wires pass to be electrically connected to the first and second tabs.

16. The NATO slave connector of claim 15 wherein the cable receiving member further comprises:

a cable grip that is adjustable to reduce the size of the opening and grip the associated electric cable to secure the associated electric cable to the cable receiving member.

17. The NATO slave connector of claim 15 wherein:

one of the attachment surface of the NATO plug and the attachment surface of the cable receiving member comprises a female portion;

the other of the attachment surface of the NATO plug and the attachment surface of the cable receiving member comprises a male portion; and, the male portion is received in the female portion when the cable receiving member is attached to the NATO plug.

18. The NATO slave connector of claim 15 wherein:

the insulation wall extends farther out from the plug surface than the first and second tabs do.

19. The NATO slave connector of claim 15 wherein:

the insulation wall is positioned substantially equidistant between the first and second tabs.

20. The NATO slave connector of claim 15 wherein:

the NATO plug comprises a cavity; and, the cable receiving member is a potting material that is inserted within the cavity.

21. The NATO slave connector of claim 15 wherein:

the attachment surface of the NATO plug comprises threads; and, the attachment surface of the cable receiving member comprises threads that engage the threads of the NATO plug when the cable receiving member is attached to the NATO plug.

* * * * *